US005660107A

United States Patent [19]

Takahashi et al.

[11] Patent Number: 5,660,107

[45] Date of Patent: Aug. 26, 1997

[54] STENCIL PRINTING DRUM WITH FRICTION REDUCING MEANS

[75] Inventors: Yasuhiro Takahashi; Katsuro Motoe; Hideo Negishi, all of Tokyo, Japan

[73] Assignee: Riso Kagaku Corporation, Tokyo, Japan

[21] Appl. No.: 507,915

[22] Filed: Jul. 27, 1995

[30] Foreign Application Priority Data

Aug. 8, 1994 [JP] Japan ..... 6-185789
Jun. 30, 1995 [JP] Japan ..... 7-165897

[51] Int. Cl.[6] ..... B41L 13/10

[52] U.S. Cl. ..... 101/116; 101/128.1

[58] Field of Search ..... 101/116, 120, 101/127.1, 128.1

[56] References Cited

U.S. PATENT DOCUMENTS

| | | | |
|---|---|---|---|
| 3,941,054 | 3/1976 | Springer | 101/409 |
| 4,911,069 | 3/1990 | Hayama et al. | 101/120 |
| 5,060,567 | 10/1991 | Hayama et al. | 101/120 |
| 5,090,312 | 2/1992 | Ohinata | 101/116 |
| 5,247,882 | 9/1993 | Zook et al. | 101/120 |

FOREIGN PATENT DOCUMENTS

| | | | |
|---|---|---|---|
| 242572 | 10/1987 | Japan | 101/116 |

*Primary Examiner*—Stephen R. Funk
*Attorney, Agent, or Firm*—Kanesaka & Takeuchi

[57] ABSTRACT

Disclosed is a printing drum of a stencil printing machine, which includes a base member having two annular members disposed at a specific space on a common central axis and a transverse bar connecting the two annular members; a flexible multi-porous sheet wrapped into a cylindrical shape around the outer peripheral surface of the base member, and around which a stencil sheet is wrapped; a stencil clamping device provided on the transverse bar of the base member for selectively clamping one end part of the stencil sheet; an inner pressing device provided on the back side of the flexible multi-porous sheet for supplying ink outwardly from the inside of the flexible multi-porous sheet, and for radially outwardly deforming the flexible multi-porous sheet by pushing outwardly the inner peripheral surface of the flexible multi-porous sheet when the base member and flexible multi-porous sheet assembly rotates on the central axis stated above; and a frictional resistance reducing device for reducing a circumferential frictional resistance which is generated between the base member and the flexible multi-porous sheet.

10 Claims, 8 Drawing Sheets

STENCIL PRINTING DRUM WITH FRICTION REDUCING MEANS

BACKGROUND OF THE INVENTION

The present invention relates to a printing drum of a stencil printing machine.

As one example of stencil printing machines, a printing machine equipped with a multi-porous cylindrical printing drum rotatably supported on the central axis has been known, in which a perforated stencil sheet is wrapped around the printing drum, and ink is supplied from inside the printing drum to the outside of the printing drum, thus performing printing on printing paper pressed against the stencil wrapped around the outer peripheral surface of the printing drum.

In the stencil printing machine with the basic construction described above, one having more concretely the following mechanism has been known. That is, a base member thereof is formed by connecting, by a transverse bar, two annular members disposed at a specific space on a common axis, and a flexible multi-porous sheet is wrapped in a cylindrical form around nearly the entire outside surface of the base member, thus constituting the printing drum of a cylindrical shape. The flexible multi-porous sheet is fastened at the leading edge part to one edge of the transverse bar and then, after being wrapped in a cylindrical form around the base member, is elastically fixed at the tail edge part to the other edge of the transverse bar through a spring member. Therefore, the flexible multi-porous sheet is so wrapped and freely seated on the annular members as to be slidable in relation to the surface of the annular members along the direction of rotation of the printing drum.

Inside the printing drum are mounted an inner pressure roller and an ink supply device for supplying ink to the surface of the inner pressure roller. When the printing drum is rotated to perform printing, the flexible multi-porous sheet is expanded outwardly in a radial direction, to rotate the inner pressure roller along the inner peripheral surface of the flexible multi-porous sheet, thus supplying ink via the flexible multi-porous sheet and the stencil. Outside the printing drum a back press roller is mounted very closely to, but not in contact with, the printing drum, so that printing is done by transferring ink to printing paper inserted between the printing drum and the back press roller. The printing drum of the above-described constitution has been disclosed for example in Japanese Patent Application No. Hei 1-47029.

According to the stencil printing machine described above, printing is performed by radially outwardly expanding a part of the printing drum while rotating the inner pressure roller along the inner peripheral surface of the flexible multi-porous sheet, and by transferring ink to the printing paper inserted between the expanded part and the back press roller. The tail edge of the flexible multi-porous sheet outwardly expanded by the inner pressure roller is pulled backwardly by the spring member in the direction of rotation of the printing drum along the outer peripheral surface of the annular section.

However, even when the flexible multi-porous sheet is freely seated on the outer peripheral surface of the annular members, considerable frictional resistance occurs in the circumferential direction of the annular members due to contact therebetween, preventing the inner pressure roller from smoothly pushing the flexible multi-porous sheet outwardly at the start of printing.

A frictional force in the circumferential direction of the annular members between the flexible multi-porous sheet and the annular members acts to prevent the inner pressure roller from pushing the flexible multi-porous sheet outwardly, resulting in an insufficient printing pressure applied to paper at the printing starting area of the printing drum which corresponds to the front part of the paper. Accordingly, it results in indistinct printing and further in an increased load to the inner pressure roller and a driving means thereof. Furthermore, ink enters between the flexible multi-porous sheet and the annular members, resulting in nonuniform frictional resistance at both sides as viewed from the transverse bar, an unbalanced contact pressure between the inner pressure roller and the inner peripheral surface of the flexible multi-porous sheet, a nonuniformly transferred amount of ink, and consequently in a nonuniform image. Also, wrinkles will form in the stencil because of different printing pressures applied to paper even at both edges of the stencil corresponding to the circumferential direction of the annular members.

SUMMARY OF THE INVENTION

It is therefore an object, of the present invention to provide a printing drum of a stencil printing machine in which a flexible multi-porous sheet is wrapped around a base member and is pushed out from inside by an inner pressure roller to perform printing, for the purpose of reducing an inner pressure roller load when the flexible multi-porous sheet is pushed out, thereby obtaining a uniform printed image.

The printing drum of a stencil printing machine according to the first aspect of the present invention comprises a base member having two annular members disposed at a specific space on a common central axis and a transverse bar connecting the two annular members; a flexible multi-porous sheet wrapped into a cylindrical shape around the outer peripheral surface of the base member, and around which a stencil sheet is wrapped; a stencil clamping means provided on the transverse bar of the base member for selectively clamping one end part of the stencil sheet; an inner pressing means provided on the back side of the flexible multi-porous sheet for supplying ink outwardly from the inside of the flexible multi-porous sheet, and for radially outwardly deforming the flexible multi-porous sheet by pushing outwardly the inner peripheral surface of the flexible multi-porous sheet when the base member and flexible multi-porous sheet assembly rotates on the central axis stated above; and a frictional resistance reducing means for reducing a circumferential frictional resistance which is generated between the base member and the flexible multi-porous sheet.

The printing drum of the stencil printing machine according to the second aspect of the present invention comprises a base member having two annular members disposed at a specific space on a common central axis and a transverse bar connecting the two annular members; a flexible multi-porous sheet which, when it is expanded, is a rectangular sheet having one end part, the other end part, and a pair of side edge parts, the one end part being fixed to the transverse bar or to the annular section in the vicinity of the transverse bar, the pair of side edge parts being wrapped around the annular members so as to be slidable in relation to the annular members, and the other end part being mounted on the transverse bar or on the annular members in the vicinity of the transverse bar so as to be movable in the circumferential direction of the annular members, thus forming a cylinder on the whole, on the outer peripheral surface of which a stencil sheet is wrapped; a stencil clamping means provided on the transverse bar of the base member, for selectively clamping one end part of the stencil sheet; an inner pressing means provided on the back side of the flexible multi-porous sheet, for supplying ink outwardly from the inside of the flexible multi-porous sheet, and for pressing the inner peripheral surface of the flexible multi-porous sheet to thereby deform the flexible multi-porous sheet radially outwardly when the base member and the flexible multi-porous sheet are rotated on the central axis; and a frictional resistance reducing means for reducing the circumferential frictional resistance occurring between the base member and the flexible multi-porous sheet.

The printing drum of the stencil printing machine according to the third aspect of the present invention is provided, in the printing drum of the stencil printing machine of the second aspect, with an elastic member mounted between the other end part of the flexible multi-porous sheet and the transverse bar or the annular members in the vicinity of the transverse bar, for elastically mounting the flexible multi-porous sheet on the base member.

The printing drum of the stencil printing machine according to the fourth aspect of the present invention, in the printing drum of the stencil printing machine of the first or second aspect, is provided with the frictional resistance reducing means including a plurality of projections provided on at least one of the base member and the flexible multi-porous sheet which are in contact with each other.

The printing drum of the stencil printing machine according to the fifth aspect of the present invention, in the printing drum of the stencil printing machine of the first or second aspect, is provided with the frictional resistance reducing means, which is a slippery member affixed on at least one of the base member and the flexible multi-porous sheet which are in contact with each other.

The printing drum of the stencil printing machine according to the sixth aspect of the present invention, in the printing drum of the stencil printing machine of the first or second aspect, the frictional resistance reducing means is a smoothed surface provided on at least one of the base member and the flexible multi-porous sheet which are in contact with each other.

The printing drum of the stencil printing machine according to the seventh aspect of the present invention, in the printing drum of the stencil printing machine of the fourth aspect, is provided with the projections on at least one of the outer peripheral surface of the annular members and the inner surface of the flexible multi-porous sheet which is in contact with the outer peripheral surfaces of the annular members.

The printing drum of the stencil printing machine according to the eighth aspect of the present invention, in the printing drum of the stencil printing machine of the seventh aspect, is provided with the projections further on at least one of the inner surface of the transverse bar and the outer surface of the flexible multi-porous sheet which is in contact with the inner surface of the transverse bar.

The printing drum of the stencil printing machine according to the ninth aspect of the present invention, in the printing drum of the stencil printing machine of the eighth aspect, is provided with an ink dam section in at least one of the base member and the flexible multi-porous sheet which are in contact with each other, for the purpose of preventing outward ink leakage from the inside of the printing drum, in the area where the base member and the flexible multi-porous sheet contact with each other; the ink dam section being substantially at the same level as the projections.

In the printing drum of the stencil printing machine according to the tenth aspect of the present invention, the projections provided in the printing drum of the stencil printing machine of the eighth aspect serve to prevent outward ink leakage from the inside of the printing drum, in the area where the base member and the flexible multi-porous sheet contact with each other.

The inner pressing means contacts the inner peripheral surface of the flexible multi-porous sheet, deforming the flexible multi-porous sheet outwardly in the radial direction. As the printing drum rotates, the flexible multi-porous sheet is partly deformed successively with rotation. After the inner pressing means moves away from the inner peripheral surface of the flexible multi-porous sheet, the flexible multi-porous sheet seats back in its former position. Since the frictional resistance reducing means is provided on at least one of the flexible multi-porous sheet and the base member which contact with each other, for reducing the frictional force in the circumferential direction of the annular members which occur between the flexible multi-porous sheet and the base member, the load applied to the inner pressing means is decreased when the flexible multi-porous sheet is outwardly deformed.

The foregoing object and other objects, aspects and advantages of the printing drum according to the present invention will become more apparent from the following detailed description thereof, when read in connection with the accompanying drawings.

DETAILED DESCRIPTION OF THE PREFERRED EMBODIMENT

Figure 1:
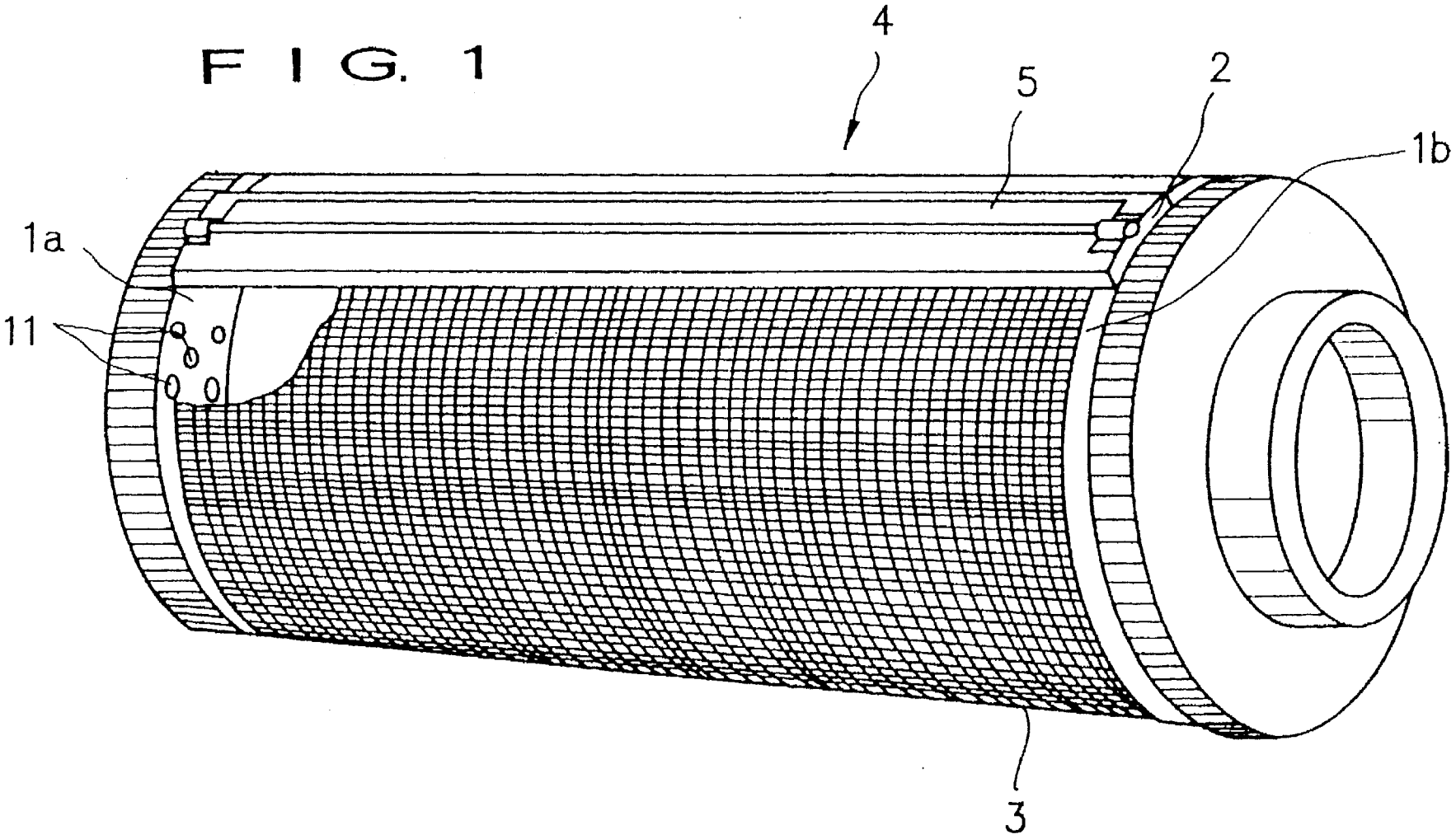
FIG. 1 is a perspective view of a printing drum of one embodiment.

One embodiment of a printing drum according to the present invention will now be explained with reference to the accompanying drawings. As shown in FIG. 1, two annular members 1*a* and 1*b* are arranged parallel at a specific space on the same rotating shaft as the central axis; these annular members 1*a* and 1*b* being connected by a transverse bar 2. The annular members 1*a* and 1*b* are each composed of a rigid solid body such as plastics or metal. The transverse bar also is similarly composed of a rigid solid body. The annular members 1*a* and 1*b* and the transverse bar 2 may be formed as one unit. The transverse bar 2 is disposed in a direction along one generating or base line of a printing drum 4, and is provided on the surface with a stencil clamping means 5 for clamping the leading end of the stencil sheet. The annular members 1*a* and 1*b* and the transverse bar 2 constitute a base member which is the basic frame of the cylindrical printing drum 4.

Wrapped around the base member along the annular members 1*a* and 1*b* is a flexible multi-porous sheet 3 having a rectangular form of when it is expanded. The flexible multi-porous sheet 3 may be a screen produced of a woven or unwoven metal wire or netting, for example a screen made of stainless wires woven lengthwise and crosswise, or also a screen of such a synthetic resin fiber as polyester, polyethylene terephthalate (TETORON), etc., or further a multi-porous plate having a multitude of fine pores. The flexible multi-porous sheet 3 may be produced of such a material that can withstand a specific pressure from the inside and outside of the printing drum 4, expanding outwardly in the radial direction of the printing drum 4 when applied with a pressure at the time of printing, and restoring when released from the pressure. The screen made of a synthetic resin alone may be reinforced with stainless steel deposited by evaporation around the resin for the purpose of improving durability.

Figure 2:
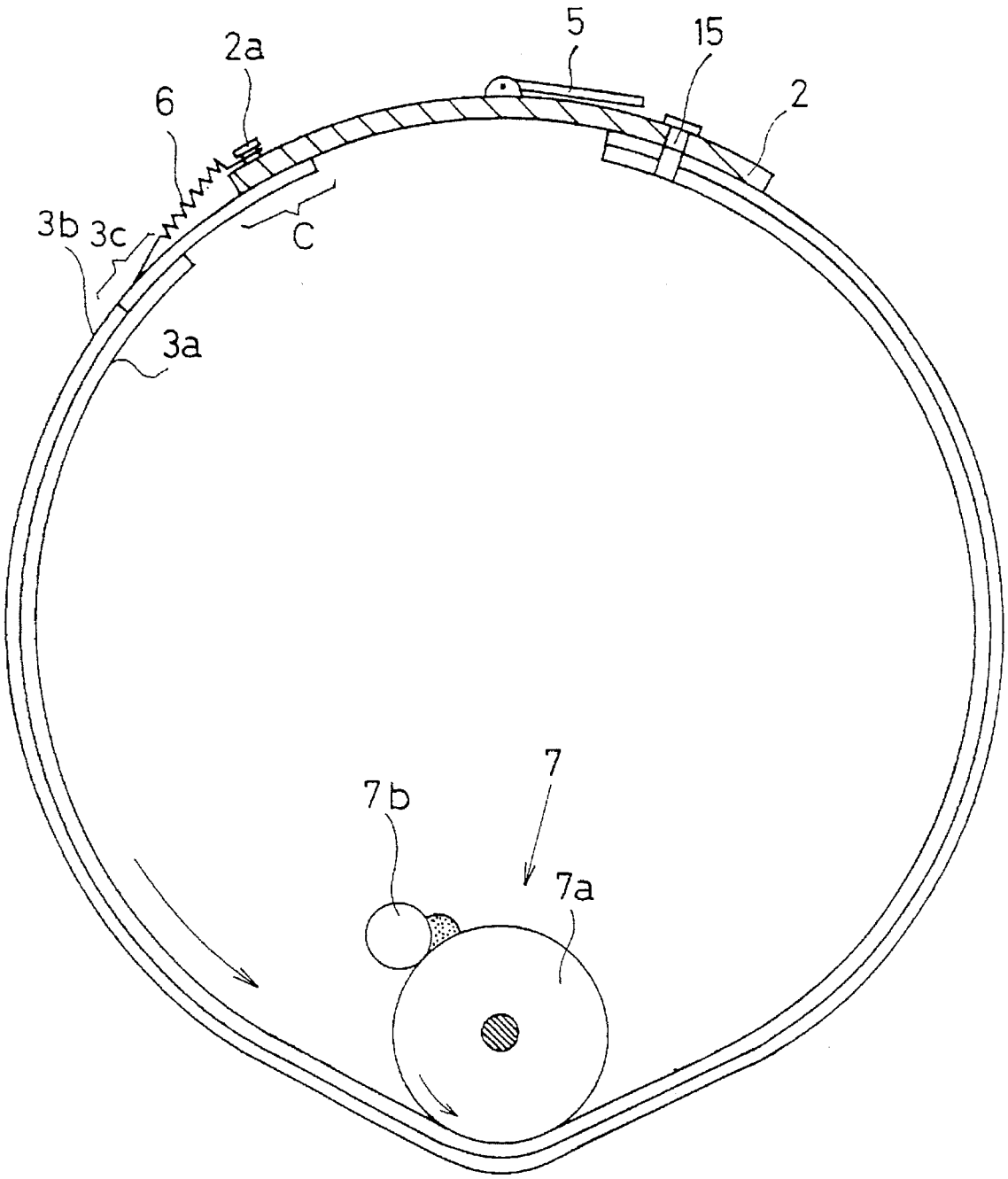
FIG. 2 is a sectional view of the printing drum of one embodiment.

Furthermore, a laminate of a plurality of flexible multi-porous sheets may be used. In FIG. 2, the annular members 1*a* and 1*b* are not illustrated; for an inner flexible multi-porous sheet 3*a* a relatively rigid stainless wire screen or a multi-porous metal sheet provided with a multitude of fine pores is used, and also for an outer flexible multi-porous sheet 3*b* a soft polyester screen deposited with stainless metal by evaporation is used. As regards the rate of a hole area of the flexible multi-porous sheet, it is preferable to provide the sheets with as high a mesh value (finer mesh) as it goes outwardly near to the stencil, for the purpose of spreading out ink supplied from the inside of the printing drum 4. Furthermore, FIG. 2 shows the inner pressing roller 7*a*, which, after contacting the inner peripheral surface of the flexible multi-porous sheet 3, has rotated as far as the position corresponding to the transverse bar with the rotation of the printing drum while continuously deforming or pushing the flexible multi-porous sheets outwardly in the radial direction.

Figure 9:
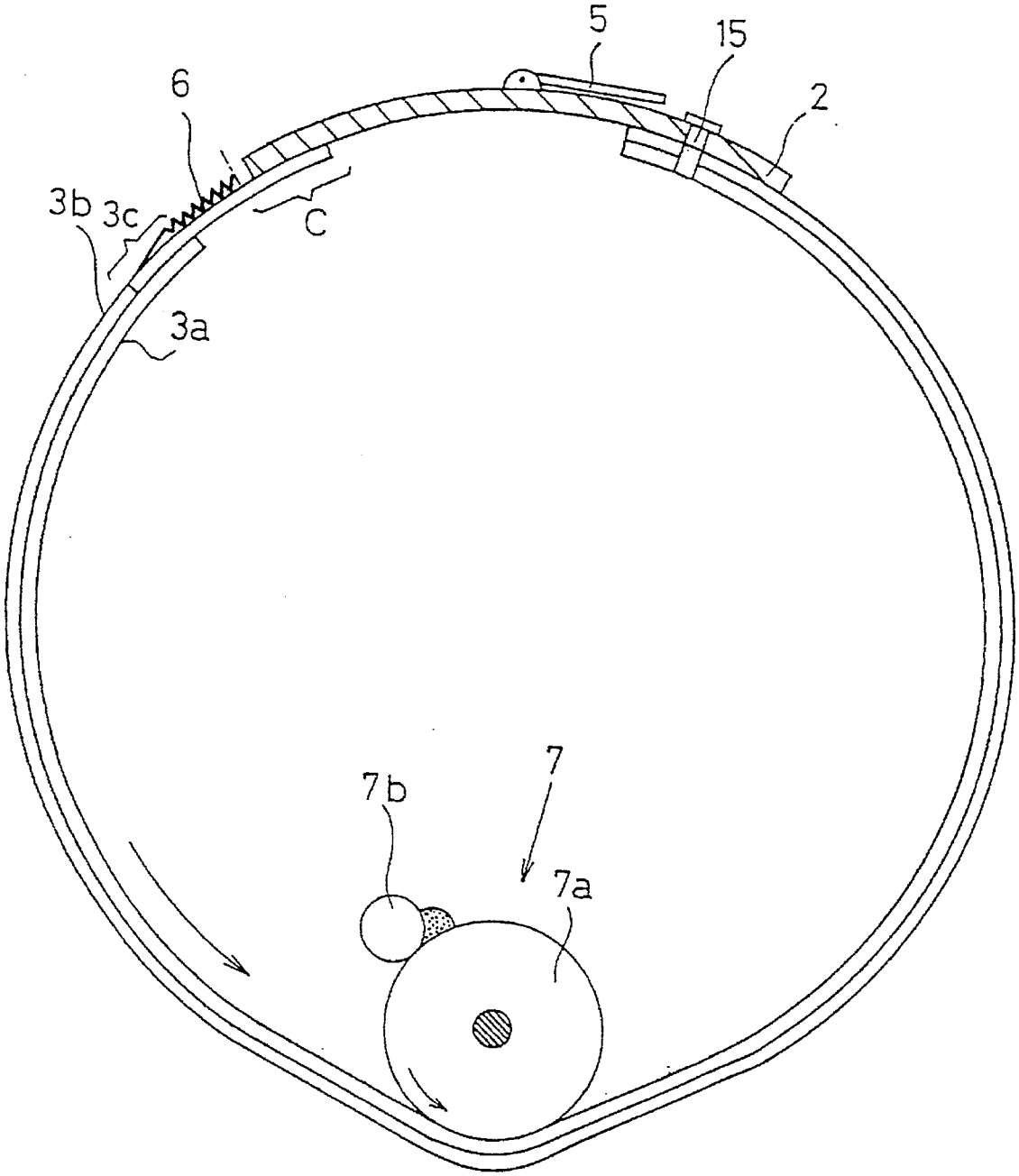
FIG. 9 is a sectional view, similar to FIG. 2, of the printing drum of a different embodiment.

The transverse bar 2 has a certain degree of width along the direction of rotation of the printing drum 4; on the delay side in the direction of rotation of the printing drum, the leading end of the flexible multi-porous sheet 3 is fastened by a fixing member 15. The leading end of the flexible multi-porous sheet 3 may be fastened directly to the transverse bar 2 and indirectly for example through a hinge. Furthermore, in FIG. 2, the leading end of the flexible multi-porous sheet 3 is located under the transverse bar 2, but may be fastened continuously integrally with the surface or edge of the transverse bar 2 and may be fastened in the vicinity of the transverse bar 2 on the external surface of the annular members 1. The flexible multi-porous sheet 3 is wrapped along the peripheral surfaces of the annular members 1*a* and 1*b* of the base member, with the tail end part thereof elastically fixed on the leading side in the direction of rotation of the transverse bar 2. As shown in FIG. 2, when the flexible multi-porous sheet 3 is composed of a plurality of sheets, only the tail end part of the outermost flexible multi-porous sheet 3*b* in contact with the stencil is elastically fixed by a nail part 2*a* of the transverse bar 2 through a spring member 6. The spring members 6 may be provided between the sheet 3 and the annular members 1, as shown in FIG. 9.

In FIG. 2, the outer and inner flexible multi-porous sheets 3*a* and 3*b* differ in length in order to prevent ink leakage at the tail end thereof; the tail end of the outer flexible multi-porous sheet 3*b* is laid under the transverse bar 2, providing an overlap area C where a part of the flexible multi-porous sheet 3*b* and a part of the transverse bar 2 are overlapped.

Figure 3:
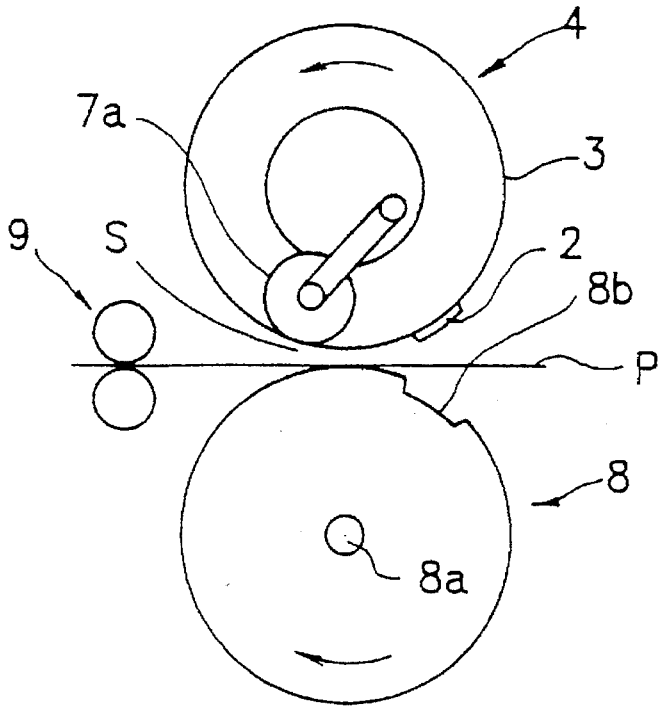
FIGS. 3(*a*) and 3(*b*) are views showing the printing operation of a stencil printing machine of one embodiment.
Figure 3:
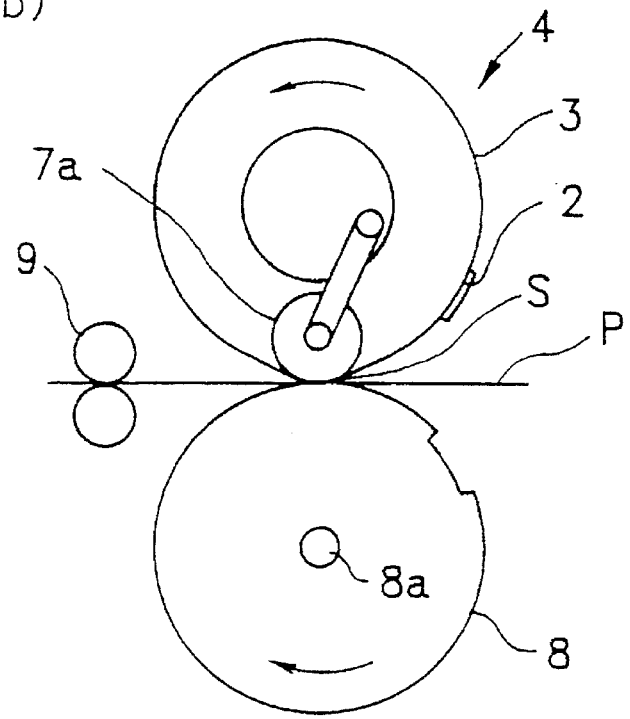

In FIG. 3, an ink supply means for supplying ink is provided within the printing drum 4. An inner pressure roller 7*a* as the inner pressing means is rotated by a driving device not illustrated, along the inner peripheral surface of the printing drum 4 (that is, the inner peripheral surface of the flexible multi-porous screen 3) with the rotation of the printing drum 4, and off the inner peripheral surface of the printing drum 4 at the non-image part including the transverse bar 2. A doctor roller 7*b* is disposed very close to the inner pressure roller 7*a*, thereby controlling the thickness of an ink layer on the surface of the inner pressure roller 7*a* and accordingly moving together as one unit with the inner pressure roller 7*a*.

Outside of the printing drum 4 is mounted the back press roller 8. The back press roller 8 is much the same in outside diameter as the printing drum 4, and is driven to rotate by the driving means not illustrated, on the center of a shaft 8*a* parallel with the rotating shaft of the printing drum 4 or to rotate simultaneously with the printing drum 4. The back press roller 8 is provided with a recessed section 8*b* in a part corresponding to the transverse bar 2 of the printing drum 4. The back press roller 8 rotates in the opposite direction simultaneously with the rotation of the printing drum 4, to hold, together with the inner pressure roller 7*a*, the paper P fed by a pair of paper feed rollers 9 to a small space S between the back press roller 8 and the printing drum 4, thus passing the paper from the left side to the right side in FIG. 3 (*a*) to perform printing by transferring ink to the paper through the stencil.

At this time, the inner pressure roller 7*a* rotating simultaneously with the rotation of the printing drum 4 deforms or pushes the flexible multi-porous sheet 3 outwardly at the front part in the direction of rotation of the printing drum 4 during the initial period of printing, to hold the paper P by the inner pressure roller 7*a* in the small space S between the printing drum 4 and the back press roller 8 as shown in FIG. 3 (*b*), thus performing printing with the ink transferred to the paper P.

There may be employed a mechanism for forcing to carry the paper P with the leading end thereof grasped with a nail part provided on the surface of the back press roller 8 at the time of printing; in this case, however, the back press roller may not be the same in diameter as the printing drum 4 and may be smaller in radius when printing is done with the paper P held simply between the printing drum 4 and the back press roller 8 as shown in FIG. 3 (*b*).

Figure 4:
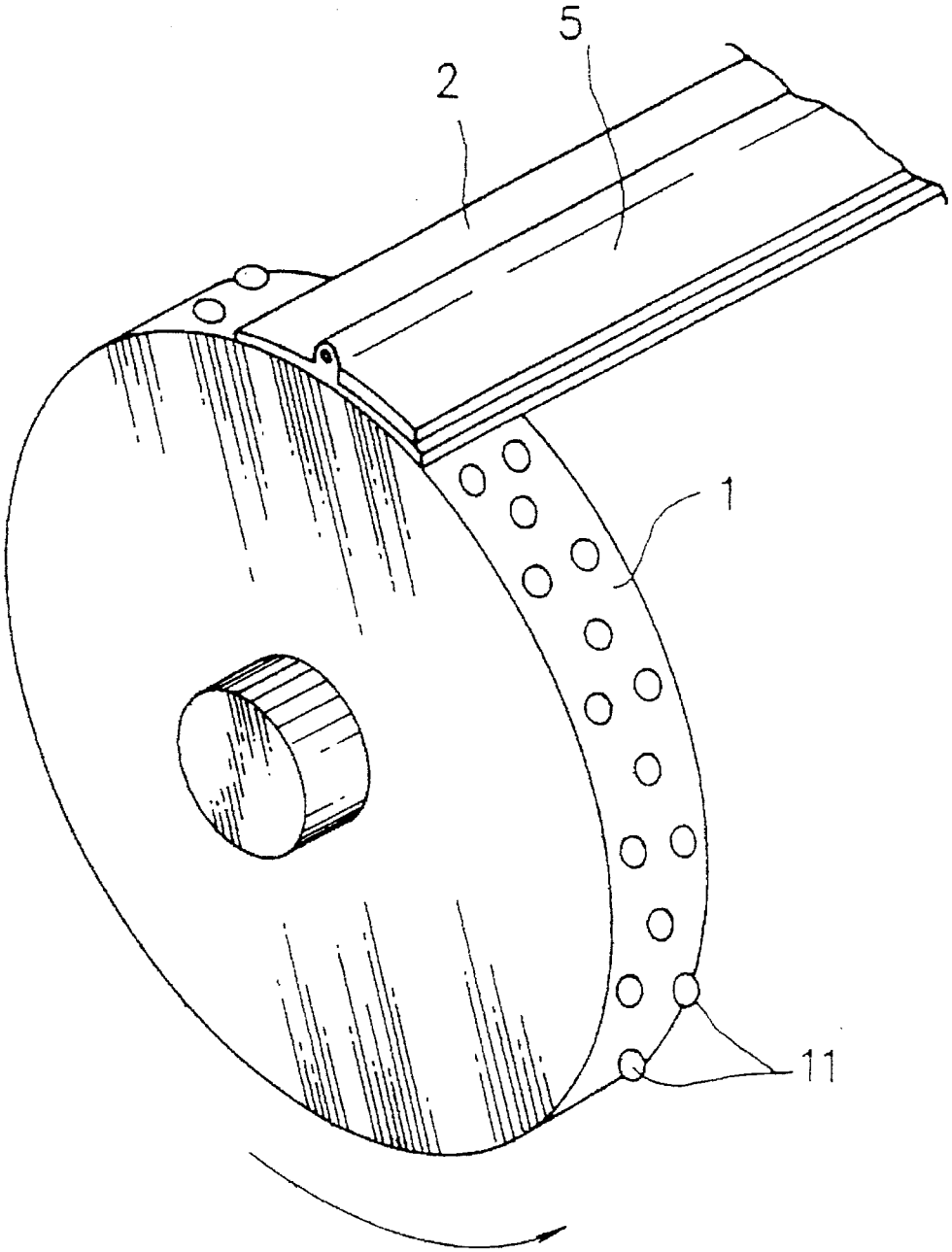
FIG. 4 is an enlarged perspective view showing one example of a shape of a major portion in the printing drum of one embodiment.

FIG. 4 shows the printing drum off the flexible multi-porous sheet 3. On the peripheral surface of the annular members 1*a* and 1*b* which contacts the flexible multi-porous sheet 3, projections 11 are provided as the frictional resistance reducing means. Each of the projections 11 is semi-spherical; a plurality of projections is regularly arranged on the entire surface of the annular members 1 which contacts the flexible multi-porous sheet 3. The projections may have any shape so long as they are of the same height, have little frictional resistance to the flexible multi-porous sheet 3 which contacts them, and will not give damage to the flexible multi-porous sheet. They preferably have a curved surface like a ball and a roller, and may rotate in the circumferential direction of the annular members 1; furthermore their size and number of arrangement can be selected as required.

Figure 5:
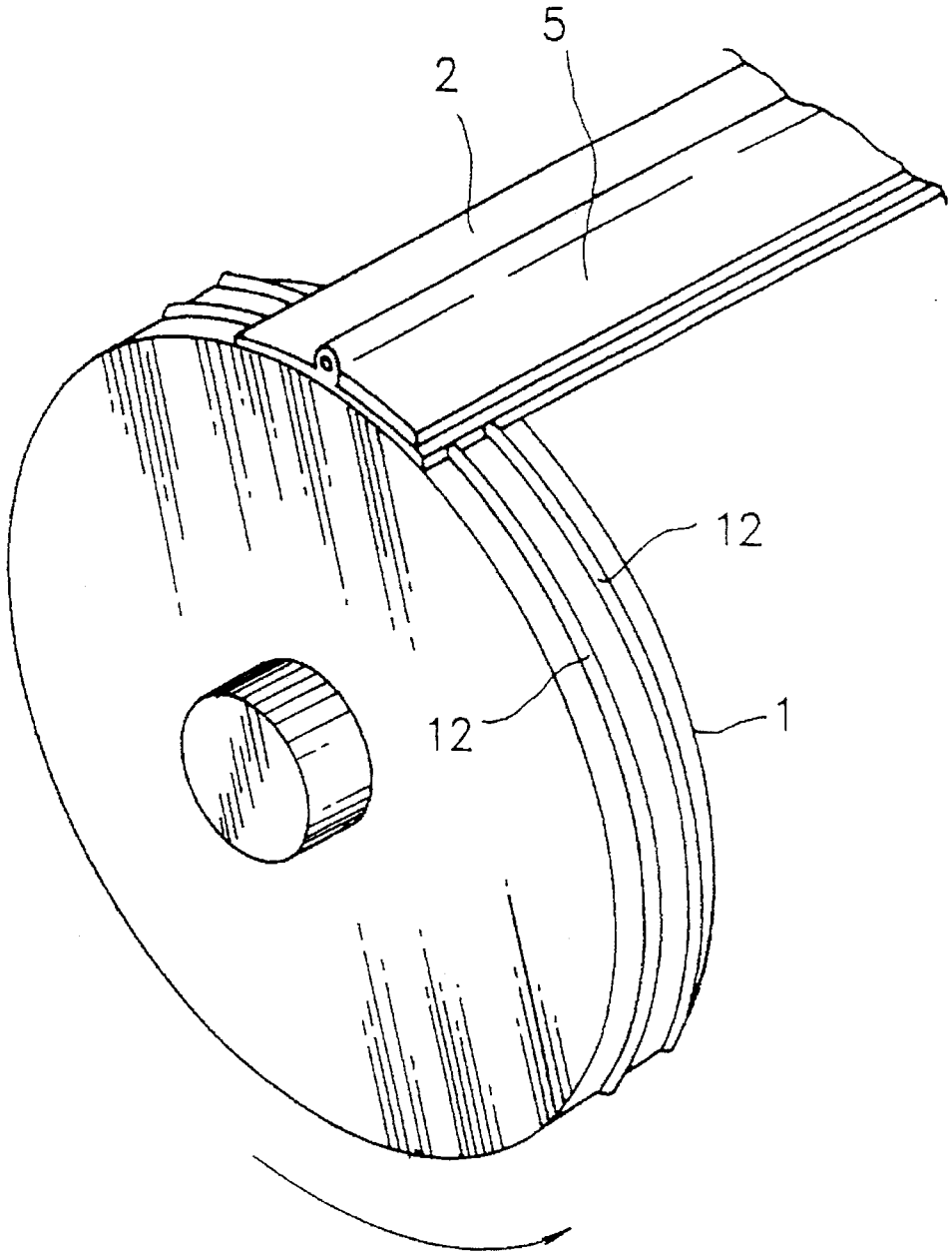
FIG. 5 is an enlarged perspective view showing another example of a shape of the major portion in the printing drum of one embodiment.

FIG. 5, like FIG. 4, is a view showing the printing drum off the flexible multi-porous sheet 3. One or a plurality of ribs 12 may be formed as the frictional resistance reducing means circumferentially on the peripheral surface of the annular members 1 which contacts the flexible multi-porous sheet 3. The rib 12 is effective to prevent ink leakage from the inside of the printing drum at a boundary between the flexible multi-porous sheet 3 and the annular members 1. The width of each rib 12 and space between the ribs 12 can be selected as desired, and when there are formed a plurality of ribs 12, their height is desired to be the same. Providing a plurality of grooves in place of these ribs can reduce the frictional resistance. Furthermore, a sliding material such as a polytetrafluoroethylene (TEFLON) tape may be affixed to form a sliding surface on the peripheral surface of each annular member 1. Furthermore, the peripheral surface itself of each annular member 1 may be smoothed by finishing the surface with polytetrafluoroethylene (TEFLON) and also may be mirror-finished.

These frictional resistance reducing means may be provided on the inner surface area of the edge of the flexible multi-porous sheet 3 which contacts the peripheral surface of the annular members 1.

In FIG. 2, the area C where the flexible multi-porous sheet **3*b* and the transverse bar 2 are overlapped will be explained. In this area C also, there takes place friction with the expansion and contraction of the spring member 6 between the flexible multi-porous sheet 3*b* and the transverse bar 2. To decrease this frictional resistance there may be provided a frictional resistance reducing means like the aforesaid projections 11 on the contact surface of the transverse bar 2 which contacts the flexible multi-porous sheet 3*b*. In this case, the frictional resistance reducing means should be provided on at least either one of the flexible multi-porous sheet 3*b* and the transverse bar 2**.

When printing is started, a perforated stencil is wrapped around the outer peripheral surface of the printing drum 4. With the rotation of the printing drum 4, the inner pressure roller **7*a* is driven, by a driving device not shown, to rotate on the inner peripheral surface of the flexible multi-porous sheet 3, or to rotate together with the printing drum 4 along the inner peripheral surface of the printing drum 4. The flexible multi-porous sheet 3 on the printing drum 4 is continuously pressed outwardly by the inner pressure roller 7*a* while rotating with the rotation of the printing drum 4, starting with the front part in the direction of rotation of the printing drum 4**.

The back press roller 8 rotates in the opposite direction simultaneously with the rotation of the printing drum 4, holding, together with the inner pressure roller **7*a*, the paper P being fed by a pair of paper feed rollers 9 into a small space S between the printing drum 4 and the back press roller 8. Printing is done while moving the paper P from the left to the right in FIG. 3** (*a*) while transferring ink to the paper through the stencil.

Since there is provided the frictional resistance reducing means on the contact surface between the base member (the annular members 1 and the transverse bar 2) and the flexible multi-porous sheet 3 for the purpose of reducing the frictional resistance between the two, the inner pressure **7*a* can smoothly press the flexible multi-porous sheet 3** outwardly during the initial period of printing.

The inner pressure roller **7*a*, in a proper timing with the rotation of the printing drum 4, moves away from the inner peripheral surface of the printing drum 4 so as not to press the non-image part including the transverse bar 2. After the inner pressure roller 7*a* has moved away from the inner peripheral surface of the printing drum 4, the flexible multi-porous sheet 3 is released from a holding force between the inner pressure roller 7*a* and the back press roller 8. The spring member 6 secured on the tail end part of the flexible multi-porous sheet 3 pulls back the flexible multi-porous sheet 3** which has been deformed or pushed outwardly by the elastic force thereof.

The frictional resistance occurring between the base member (the annular members **1*a* and 1*b* and the transverse bar 2) and the flexible multi-porous sheet 3 during the operation described above will be explained in further detail. First, when the inner pressure roller 7*a* in contact with the inner peripheral surface of the printing drum 4 presses the printing drum 4 outwardly, the spring member 6 extends and at the same time the frictional resistance occurs between the base member and the flexible multi-porous sheet 3**.

Thereafter, during the rotation of the printing drum 4 the amount of extension of the spring member 6 remains unchanged; also, the flexible multi-porous sheet 3 remains outwardly deformed and there will not move circumferentially, so that there occurs no frictional resistance between the base member and the flexible multi-porous sheet 3.

At the very instant that the inner pressure roller **7*a* moves away from the inner peripheral surface of the printing drum 4, only the expanded area of the flexible multi-porous sheet 3 being pressed by the inner pressure roller 7*a* is released; there occurs no frictional resistance between the annular members 1*a* and 1*b* and the flexible multi-porous sheet 3. This is because, in the present embodiment, the inner pressure roller 7*a* withdraws from the inner surface of the printing drum 4, in the vicinity of the tail end part of the flexible multi-porous sheet 3*a***.

However, when for example the inner pressure roller **7*a* is in a position shown in FIG. 2, if there has taken place any trouble with the printing machine or if an imaged area of the stencil is over, it is possible to control the machine to move the inner pressure roller 7*a* away from the inner peripheral surface of the printing drum 4. In this case, the flexible multi-porous sheet is pulled back by the spring member 6 on the delay side (on the left side of the inner pressure roller 7*a* in FIG. 2) in the direction of rotation of the printing drum 4**, causing a frictional resistance to occur between the flexible multi-porous sheet and the peripheral surface of each annular member.

In the overlap area C the inner surface side of the transverse bar is in contact with the flexible multi-porous sheet 3 and therefore there occurs a frictional resistance in the contact area at the instant the inner pressure roller **7*a* moves off the inner peripheral surface of the printing drum 4 regardless of the position where the inner pressure roller 7*a* comes off the inner peripheral surface of the printing drum 4**.

According to the present apparatus, as heretofore explained, there takes place the frictional resistance in a contact area between the base member and the flexible multi-porous sheet which is on the delay side of the position of the inner pressure roller **7*a* in the direction of rotation of the printing drum, when the inner pressure roller 7*a*** moves into contact with, or away from, the inner peripheral surface of the printing drum.

Figure 6:
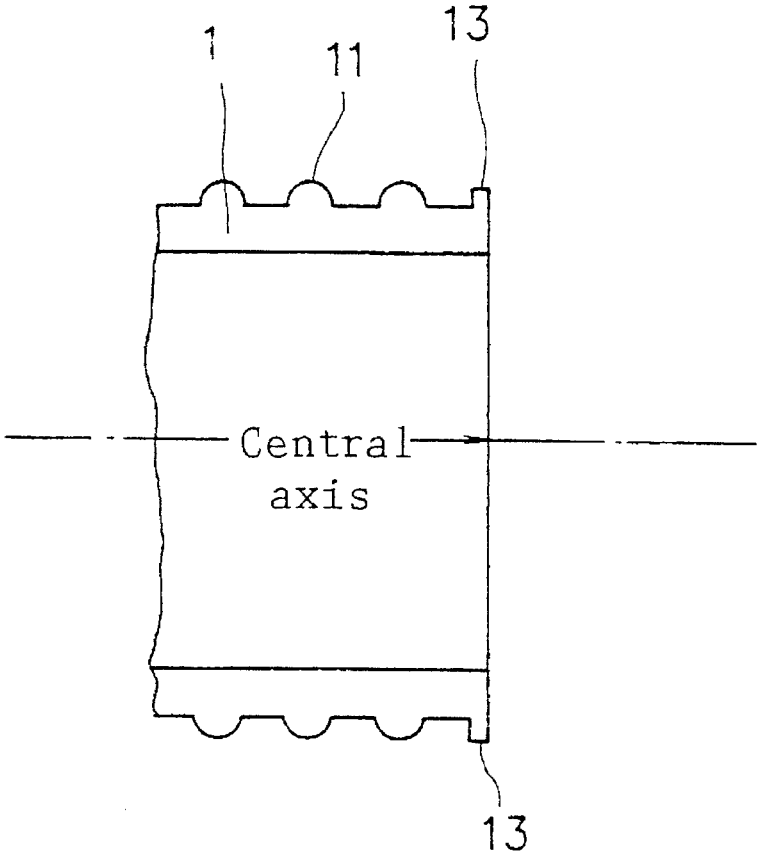
FIG. 6 is a sectional view showing another example of a shape of the major portion of the printing drum of one embodiment.

If a clearance is provided between the flexible multi-porous sheet 3 and the annular members 1 or the transverse bar 2 by forming the aforesaid projections 11 in an attempt to reduce the frictional resistance by decreasing the contact surface area between them, printing ink is likely to enter the clearance. To prevent ink leakage out of the printing drum 4, a dam section 13 which is as high as the projections 11 or the ribs 12 may be continuously provided as shown in FIG. 6. The dam section 13, in the case of the annular members 1, is to be provided continuously along the circumferential direction of the annular members 1, in an edge part near the center of the rotating shaft of the printing drum 4.

Figure 7:
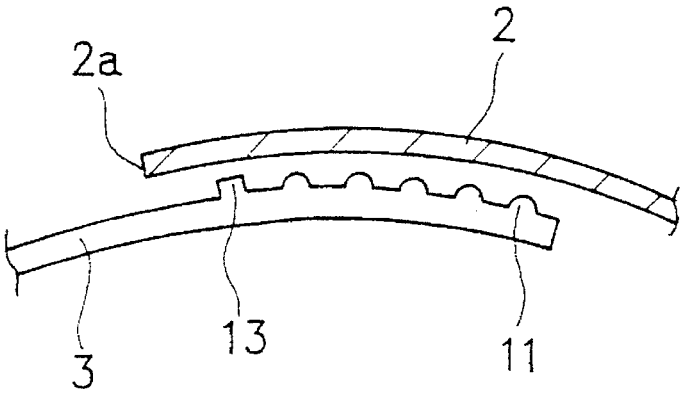
FIG. 7 is a sectional view showing another example of a shape of the major portion of the printing drum of one embodiment.

In the printing drum of such a construction that the flexible multi-porous sheet 3*b* and the transverse bar 2 are overlapped in the area C as shown in FIG. 2, the prevention of ink leakage from inside the printing drum 4 requires the provision of a continuous dam section 13 which contacts the inside of the edge part 2*a* of the transverse bar 2, parallel with the rotating shaft, on the upper surface of the tail end part of the flexible multi-porous sheet 3 overlapping with the transverse bar 2 as shown in FIG. 7.

Figure 8:
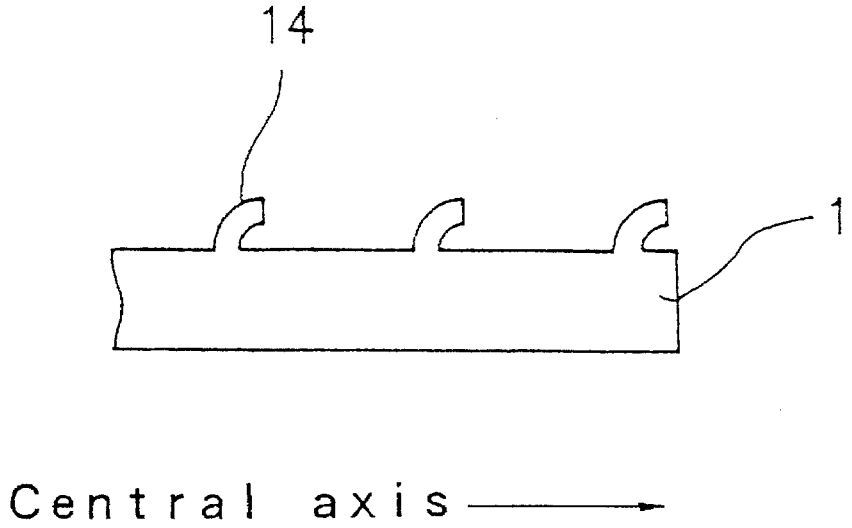
FIGS. 8(*a*) and 8(*b*) are sectional views showing further another example of a shape of the major portion of the printing drum of one embodiment.
Figure 8:
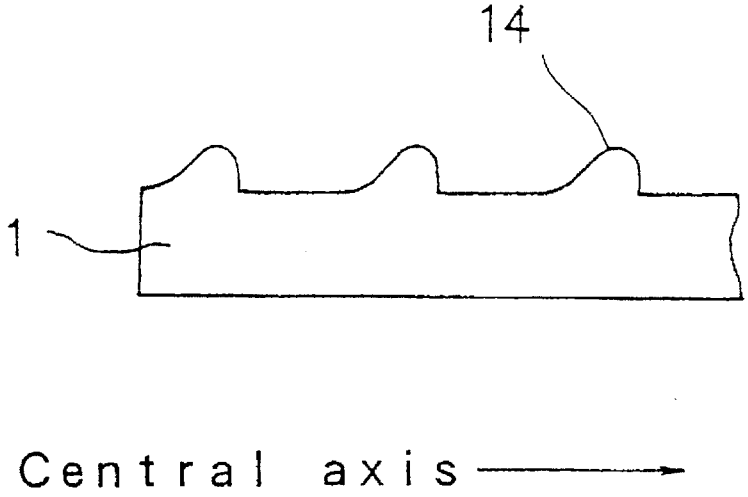

Also as shown in FIGS. 8 (*a*) and 8 (*b*), projections 14 to be provided on the peripheral surface of the annular members 1 for the purpose of decreasing the frictional resistance may be so formed as to prevent ink leakage out from the inside of the printing drum 4. In this case, it is preferable that the projections or dam have such configurations as to prevent the outward movement of ink from the center side with respect to the rotating shaft of the printing drum 4.

The preferred embodiment of the present invention has been explained in detail but it is apparent to those skilled in the art that the scope of the present invention is not limited thereto and various applications and variations can be made.

In the printing drum of the stencil printing machine of the present invention, the flexible multi-porous sheet is elastically wrapped around the base member, and the sheet is pressed from inside by the inner pressing means to perform printing; and the frictional resistance reducing means is provided on the contact surface between the base member and the flexible multi-porous sheet, thereby reducing load applied to the inner pressure roller during pressing.

What is claimed is:

1. A printing drum of a stencil printing machine using a stencil sheet, comprising:

a base member having two annular members arranged at a specific space on a common central axis and a transverse bar connecting said two annular members;

a flexible multi-porous sheet wrapped on an outer peripheral surface of said base member to make a cylindrical shape and having one and the other end parts, said outer peripheral surface being adapted to be wrapped with the stencil sheet;

an elastic member provided between said other end part of said flexible multi-porous sheet and said transverse bar or between said other end part and said annular members in a vicinity of said transverse bar, for elastically mounting said flexible multi-porous sheet on said base member;

stencil clamping means provided on said transverse bar of said base member adapted to selectively clamp one end part of said stencil sheet;

inner pressing means provided inside said flexible multi-porous sheet to supply ink outwardly from an inside of said flexible multi-porous sheet so that when said base member and said flexible multi-porous sheet are rotated on the central axis, an inner peripheral surface of said flexible multi-porous sheet is pressed to deform said flexible multi-porous sheet radially outwardly; and frictional resistance reducing means having a plurality of projections provided on at least one of said base member and said flexible multi-porous sheet contacting with each other.

2. A printing drum of a stencil printing machine as claimed in claim 1, wherein said projections are provided on at least one of an outer peripheral surface of said annular members and the inner surface of said flexible multi-porous sheet which contacts said outer peripheral surface of said annular members.

3. A printing drum of a stencil printing machine as claimed in claim 2, wherein said projections are provided further on at least one of an inner surface of said transverse bar and an outer surface of said flexible multi-porous sheet which contacts said inner surface of said transverse bar.

4. A printing drum of a stencil printing machine as claimed in claim 3, wherein a dam section for preventing outward ink leakage from the inside of said printing drum at a contact area between said base member and said flexible multi-porous sheet is provided in at least one of said base member and said flexible multi-porous sheet which contact each other; said dam section having substantially the same height as said projections.

5. A printing drum of a stencil printing machine as claimed in claim 4, wherein said projections prevent outward ink leakage from the inside of said printing drum at said contact area between said base member and said flexible multi-porous sheet.

6. A printing drum of a stencil printing machine using a stencil sheet, comprising:

a base member having two annular members arranged at a specific space on a common central axis and a transverse bar connecting said two annular members;

a flexible multi-porous sheet of a rectangular shape when it is expanded, said flexible multi-porous sheet having one end part and the other end part, and a pair of side edge parts; said one end part being fixed on said transverse bar or on said annular members in a vicinity of said transverse bar; said pair of side edge parts being wrapped around said annular members in such a manner that said flexible multi-porous sheet is slidable on said annular members; and said other end part being attached on said transverse bar or on said annular members in a vicinity of said transverse bar in such a manner that the flexible multi-porous sheet is movable in the circumferential direction of said annular members, forming a cylindrical shape on the whole, and that the stencil sheet is adapted to be wrapped around an outer peripheral surface thereof;

an elastic member provided between said other end part of said flexible multi-porous sheet and said transverse bar or between said other end part and said annular members in a vicinity of said transverse bar, for elastically mounting said flexible multi-porous sheet on said base member;

stencil clamping means provided on said transverse bar of said base member adapted to selectively clamp one end part of said stencil sheet;

inner pressing means provided inside said flexible multi-porous sheet to supply ink outwardly from an inside of said flexible multi-porous sheet so that when said base member and said flexible multi-porous sheet are rotated on the central axis, an inner peripheral surface of said flexible multi-porous sheet is pressed to deform said flexible multi-porous sheet radially outwardly; and frictional resistance reducing means having a plurality of projections provided on at least one of said base member and said flexible multi-porous sheet contacting with each other.

7. A printing drum of a stencil printing machine as claimed in claim 6, wherein said projections are provided on at least one of an outer peripheral surface of said annular members and the inner surface of said flexible multi-porous sheet which contacts said outer peripheral surface of said annular members.

8. A printing drum of a stencil printing machine as claimed in claim 7, wherein said projections are provided further on at least one of an inner surface of said transverse bar and an outer surface of said flexible multi-porous sheet which contacts said inner surface of said transverse bar.

9. A printing drum of a stencil printing machine as claimed in claim 8, wherein a dam section for preventing outward ink leakage from the inside of said printing drum at a contact area between said base member and said flexible multi-porous sheet is provided in at least one of said base member and said flexible multi-porous sheet which contact each other; said dam section having substantially the same height as said projections.

10. A printing drum of a stencil printing machine as claimed in claim 9, wherein said projections prevent outward ink leakage from the inside of said printing drum at said contact area between said base member and said flexible multi-porous sheet.

* * * * *